US007317397B2

(12) United States Patent
Gunsauley

(10) Patent No.: US 7,317,397 B2
(45) Date of Patent: Jan. 8, 2008

(54) METHOD AND APPARATUS FOR USING RFID'S IN THE INVESTIGATION OF MOTOR VEHICLE ACCIDENTS

(76) Inventor: Rodney Melvin Gunsauley, 4024 N. 17th St., Arlington, VA (US) 22207

( * ) Notice: Subject to any disclaimer, the term of this patent is extended or adjusted under 35 U.S.C. 154(b) by 45 days.

(21) Appl. No.: 11/139,487

(22) Filed: May 31, 2005

(65) Prior Publication Data

US 2006/0006982 A1 Jan. 12, 2006

Related U.S. Application Data

(60) Provisional application No. 60/651,552, filed on Feb. 10, 2005, provisional application No. 60/617,631, filed on Oct. 12, 2004, provisional application No. 60/575,261, filed on May 29, 2004.

(51) Int. Cl.
*G08B 13/14* (2006.01)

(52) U.S. Cl. ..... 340/572.1; 340/10.1; 340/10.42; 340/539.1; 340/572.8; 340/933

(58) Field of Classification Search ..... 340/572.1, 340/10.1, 10.31, 933, 10.42, 5.8, 539.1, 572.8; 701/1, 35; 235/375, 380
See application file for complete search history.

(56) References Cited

U.S. PATENT DOCUMENTS

| | | | | |
|---|---|---|---|---|
| 6,052,068 | A * | 4/2000 | Price R-W et al. | 340/933 |
| 6,167,333 | A * | 12/2000 | Gehlot | 701/35 |
| 6,452,507 | B1 * | 9/2002 | Friedman | 340/928 |
| 6,876,296 | B2 * | 4/2005 | Talmadge et al. | 340/10.42 |
| 7,068,185 | B2 * | 6/2006 | Kavner | 340/933 |

* cited by examiner

*Primary Examiner*—Davetta W. Goins
(74) *Attorney, Agent, or Firm*—Shoemaker and Mattare

(57) ABSTRACT

This invention involves the use of an apparatus that would be attached to specific areas of motor vehicles. Contained within this apparatus would be a plurality of (code bearing) radio frequency identifier devices or "RFID's." Since these codes would be unique to the motor vehicle to which they were assigned; it would now be possible to identify vehicles involved in hit and run accidents by the evidence they would leave behind—in the form of RFID's.

13 Claims, 11 Drawing Sheets

Device holder attached to vehicle with typical wraparound design. Circled areas highlight protruding receptacle.

Device holder attached to vehicle with typical wraparound design. Circled areas highlight protruding receptacle.

Device holder attached to vehicle with typical wraparound design. Circled areas highlight protruding receptacle.

AutoCheck Vehicle History Reports: Sample Report Warning

Vehicle Description | TitleCheck | ProblemCheck | OdometerCheck | Vehicle Information | Full History

Full History Back to top

Below are the historical events for this vehicle listed in chronological order. Any discrepancies will be in bold text.

8 ~ VIN: 4T1BE32K32U610797 2002 Toyota Camry LE/SE/XLE ~ 9

| Event Date | Event Location | Odometer Reading | Data Source | Event Detail |
|---|---|---|---|---|
| 07/10/2002 | MI | 12 | Motor Vehicle Dept. | TITLE (Title #:117N1910243) |
| 07/10/2002 | MI | | Motor Vehicle Dept. | REGISTRATION EVENT/RENEWAL |
| 09/20/2002 | KY | | State Agency | LEFT SIDE IMPACT WITH ANOTHER VEHICLE |
| 10/25/2002 | FL | 8,950 | Motor Vehicle Dept. | ODOMETER READING FROM DMV |
| **11/08/2002** | **BOCA RATON, FL** | | **Motor Vehicle Dept.** | **TITLE (Title #:0086760226) REBUILT/REBUILDABLE SALVAGE** |
| 12/11/2003 | FL | 7,747 | Motor Vehicle Dept. | ODOMETER READING FROM DMV |
| **12/20/2002** | **OCOEE, FL** | | **Motor Vehicle Dept.** | **TITLE (Title #:0086760226) REBUILT/REBUILDABLE SALVAGE** |
| 01/30/2003 | MIAMI, FL | | Motor Vehicle Dept. | TITLE (Title #:0086760226) |
| 01/30/2003 | MIAMI, FL | | Motor Vehicle Dept. | REGISTRATION EVENT/RENEWAL |
| **01/30/2003** | **MIAMI, FL** | | **Motor Vehicle Dept.** | **REBUILT/REBUILDABLE** |
| 10 ~ 03/04/2003 | MIAMI, FL | | Motor Vehicle Dept. | TITLE (Title #:0086760226) DUPLICATE TITLE REBUILT/REBUILDABLE |

FIG. 9

3. Reader decodes and transmits to the laptop.

1. Reader sends energy to tag for power.

2. Tag sends ID data back to the reader

11 ~ RFID: 838472AD3482FCE9 VIN: 1J4FJ28S6ML589224 ~ 12

Model: 1991 Jeep Cherokee ~ 13

| Event Date | Location | Title# | Data Source |
|---|---|---|---|
| 5/06/1991 | DC. | #J714963 Lien Reported | Motor Vehicle Dept. |
| 5/06/1993 | DC. | Failed Emission Inspection | Motor Vehicle Dept. |
| 6/16/1994 | Eastern Region | Reported at Auto Auction | Auto Auction |
| 2/09/1995 | Woodbridge Va. | Odometer Reading from DMV | Motor Vehicle Dept. |
| 4/08/1996 | Woodbridge Va. | Registration Event/Renewal | Motor Vehicle Dept. |
| 4/02/1998 | Woodbridge Va. | Registration Event/Renewal | Motor Vehicle Dept. |
| 4/30/1998 | Falls Church Va. | Passed Emission Inspection | Independent Emission Source |
| 5/01/1998 | Woodbridge Va. | Registration Event/Renewal | Motor Vehicle Dept. |
| 2/12/2000 | Vienna Va. | Passed Emission Inspection | Independent Emission Source |
| 5/02/2000 | Vienna Va. | Registration Event/Renewal | Motor Vehicle Dept. |
| 5/14/2002 | Vienna Va. | Registration Event/Renewal | Motor Vehicle Dept. |
| 6/01/2004 | Vienna Va. | Registration Event/Renewal | Motor Vehicle Dept. |

14 ~

FIG. 11

METHOD AND APPARATUS FOR USING RFID'S IN THE INVESTIGATION OF MOTOR VEHICLE ACCIDENTS

PRIORITY CLAIM

The present application claims priority to the following: U.S. Provisional Patent Application having Ser. No. 60/651,552 filed on Feb. 10, 2005, U.S. Provisional Patent Application having Ser. No. 60/617,631 filed on Oct. 12, 2004, and U.S. Provisional Patent Application having Ser. No. 60/575,261 filed on May 29, 2004. Parts of which are hereby incorporated by reference.

FIELD OF THE INVENTION

The present invention relates to the field of accident investigation and reconstruction.

BACKGROUND OF THE INVENTION

In the past, the collection of evidence at accident scenes has always been piecemeal at best. The present technology is limited to the matching of such items as car parts, paint, etc. in order to determine the make and model of a vehicle.

Additionally, because of the split second time frames (and the trauma that can often be associated with such an event), eyewitness accounts of what transpired can either be unreliable in nature or non-existent.

To solve the above problems, the present invention would employ a novel use of a present technology in the investigation of motor vehicle accidents. The technology referred to in this application is commonly known as "taggants."

Taggants (i.e. visible or invisible indicia used to mark a product for the purposes of identification and/or verification) are often used for such essential tasks as tracking the shipment of goods, inventory control, document authentication, etc.

By using radio frequency identifier devices or "RFID's" as the above named taggants, it will now be possible to identify drivers who are involved in "hit and run" accidents.

More specifically, by the use of RFID's that would be left at the scene of such accidents, it will now be possible to bring to justice those who commit these "hit and run" crimes. A particularly gratifying use of this invention would be in bringing to justice those who commit the most heinous of these crimes: ones involving personal injury and death.

"Hit and run accidents in the United States have increased fifteen percent over the past five years. On average, motor vehicles are involved in 3.5 million hit and run accidents each year. Hit and run accidents account for one in five pedestrian fatalities . . . " (From a report compiled by the National Center For Statistics and Analysis and released by the National Highway Traffic Safety Administration on Apr. 22, 2003.)

SUMMARY OF THE INVENTION

The present invention provides a device that will affix to the front, rear and sides of a motor vehicle; contained within these devices will be a plurality of radio frequency identifier devices or "RFID's."

It is an object of the present invention that the RFID's contained within these devices be programmed with a single, unique (and encrypted) code that will be proprietary to the motor vehicle to which they are assigned.

It is a further object of the present invention that they perform this function by serving as a "co-identifier" for the vehicle identification (or "vin") number of the motor vehicle to which they are assigned; vin numbers themselves being unique to each motor vehicle.

It is an object of the present invention that these device holders be composed of a breakable material; causing them to fracture when impacting with another object.

It is a further object of the present invention that this fracturing of the device holder will cause a number of the RFID's (contained within their compartments) to be released.

It is an object of the present invention that the RFID's recovered from the scene of a motor vehicle accident would have their codes compared with their listings in a designated company's proprietary database; this database having been set up for that purpose.

It is a further object of the present invention that the comparing of these codes would yield the following information:

a. the vehicle identification (or "vin") number of the motor vehicle b. the year of manufacture of the motor vehicle c. the make of the motor vehicle d. the model of the motor vehicle e. the current state of registration for the motor vehicle It is a further object of the present invention that the specific state Department of Motor Vehicles provided by the proprietary database be contacted to obtain the identity of the owner.

BRIEF DESCRIPTION OF THE DRAWINGS

FIG. 9 shows an example of a vehicle history report from a website called "AutoCheck.com."

FIG. 11 shows an example of a printout from the proprietary database.

DETAILED DESCRIPTION OF THE PREFERRED EMBODIMENTS

It is to be noted that at the time of this filing, the cost of implementing the system described below would be less than two hundred dollars per vehicle. With experts predicting RFID chips of five cents each in the near future—that cost would then be cut in half.

Types of RFID Tags

Figure 1:
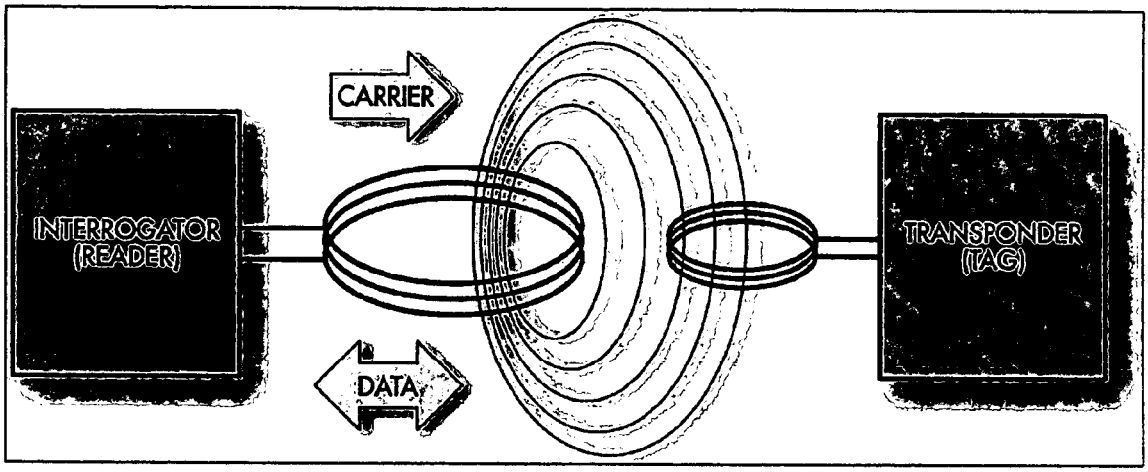
FIG. 1 is an example of a basic RFID system and it's components.

RFID tags are categorized as either active or passive. Active RFID tags are powered by an internal battery; while passive RFID tags operate without a separate external power source and obtain operating power generated from the reader. (See FIG. 1). Passive tags are consequently much lighter than active tags, less expensive, and offer a virtually unlimited operational lifetime.

Pursuant to the present invention, provision is made for passive RFID tags to be used.

Specifics of the Present Invention

RFID Device Holder Design

Figure 2:
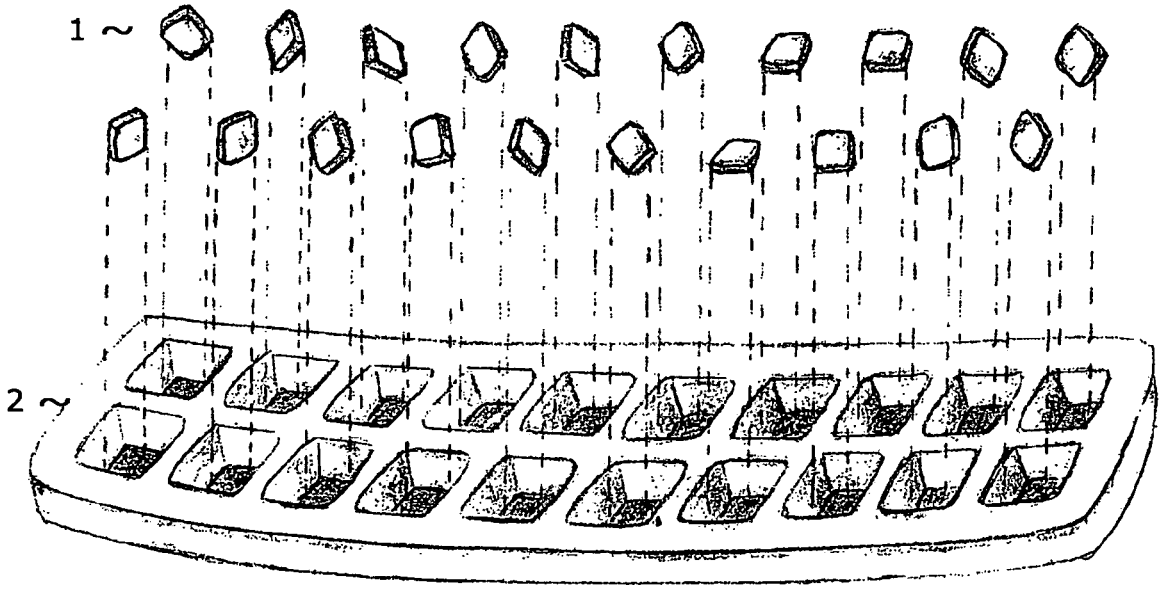
FIG. 2 shows how the RFID's would be "loaded" into the device holder.

Referring to FIG. 2, the device holder (2) that releases the RFID's (1) would have three parts. The first of which would be a:

Substrate

Figure 5:
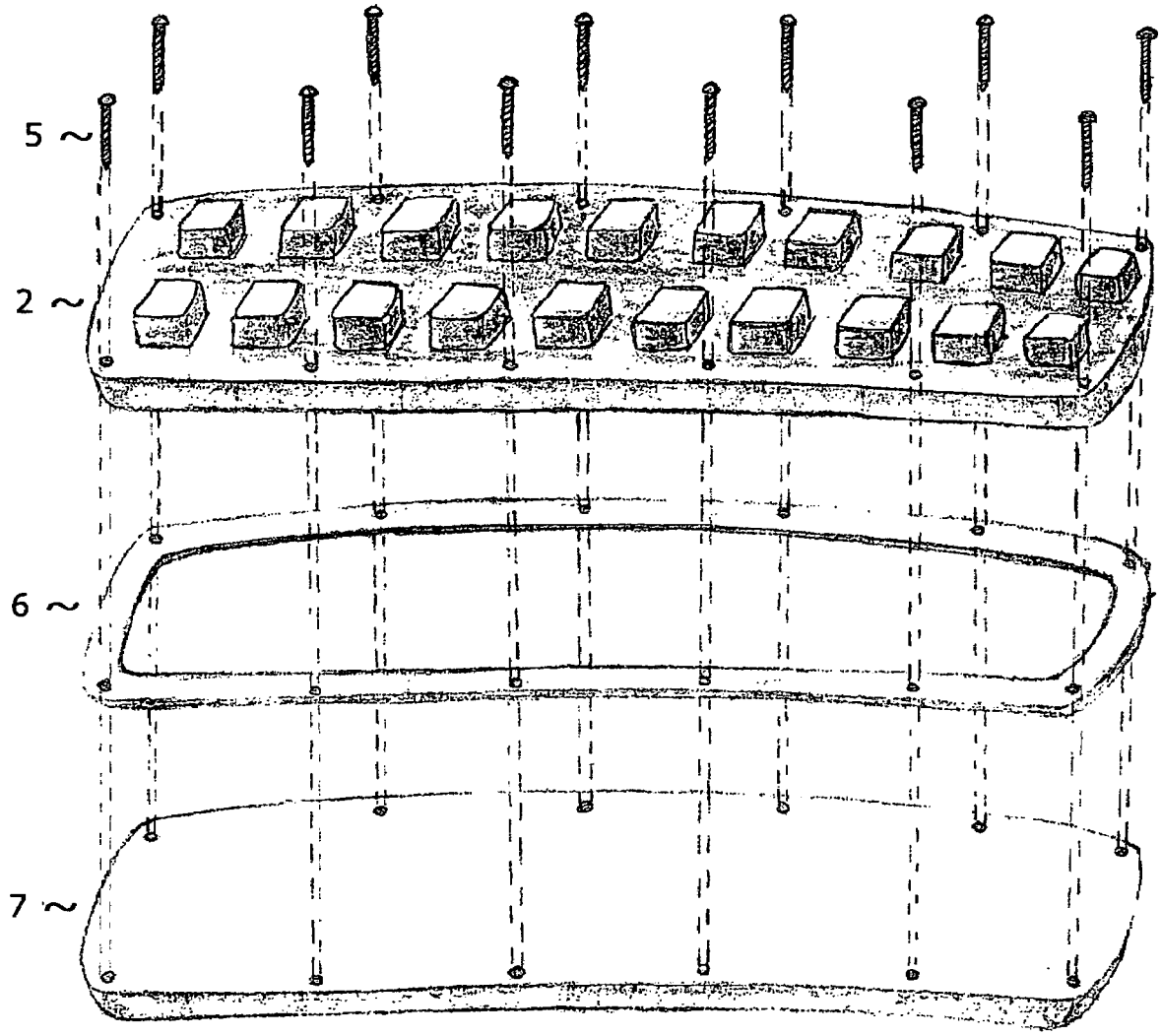
FIG. 5 is an exploded view showing all parts of a device holder.

Referring to FIG. 5, the substrate (7) or "base" of the device holder would be typically rectangular in design and made of a flexible material. It would have a length equal to that of the particular motor vehicle to which it is attached; traversing the full length of the front and rear bumpers (or "impact areas") in order to provide the maximum amount of coverage. Evenly spaced holes along its sides would align it to the other two components of the device holder.

In accordance with a further aspect of the invention, provision would be made for a substrate to be attached to each side of a motor vehicle. Like the others, it too would be rectangular in design and traverse the full length of the motor vehicle.

Figure 3:
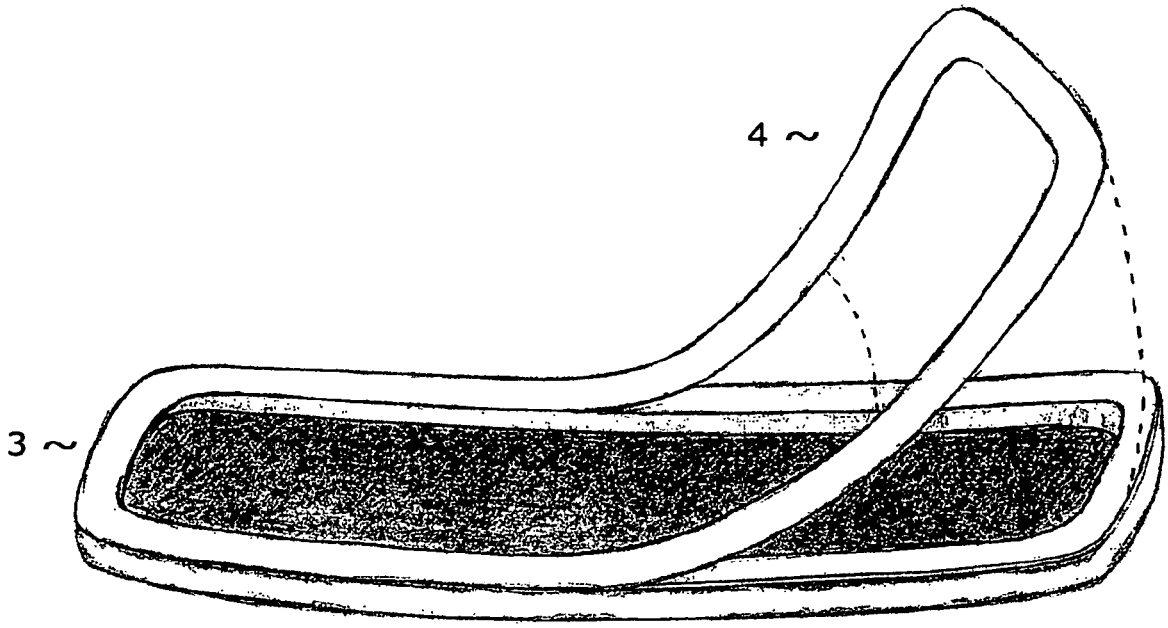
FIG. 3 shows the back of a device holder substrate with it's pre-formed adhesive and liner.

Referring to FIG. 3, the bottom of each substrate would have a pre-formed layer of adhesive (3) attached to its surface. This adhesive strip would have a "cut out" center giving the bottom of the substrate a circumferential border. This layer would be covered by a thin paper strip (4) or "liner". This protective liner would be peeled back and the substrate attached to the vehicle surface with a uniform pressure fit.

Gasket

Referring again to FIG. 5, a gasket (6) would be used between the substrate (7) and the lens (2) to protect the device holder from moisture and other contaminants. This gasket would be made of a flexible and waterproof material; having the same dimensions as its companion substrate and lens. Evenly spaced holes along its sides would align it to both the substrate and lens.

Lens

Referring again to FIG. 5, the "RFID bearing" lens (2) or "cover" would be made of an opaque colored, breakable material that is sunlight resistant. The inside surfaces would (preferably) be coated with either a fluorescent or an infrared paint to aid in its recovery when fractured. It would have the same length and width as its companion gasket and substrate. Evenly spaced holes along its sides would mate the lens to its base and thus the lens, its underlying gasket and the substrate would be assembled as a single unit.

Figure 4:
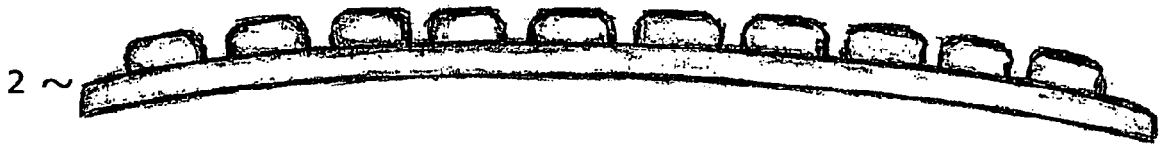
FIG. 4 shows an elevation (top) view of a device holder.

Referring to FIG. 4, an elevation (top) view is shown depicting how the profile of the device holder would protrude out from the surface of the vehicle body.

Figures 7, 7A, 7B:
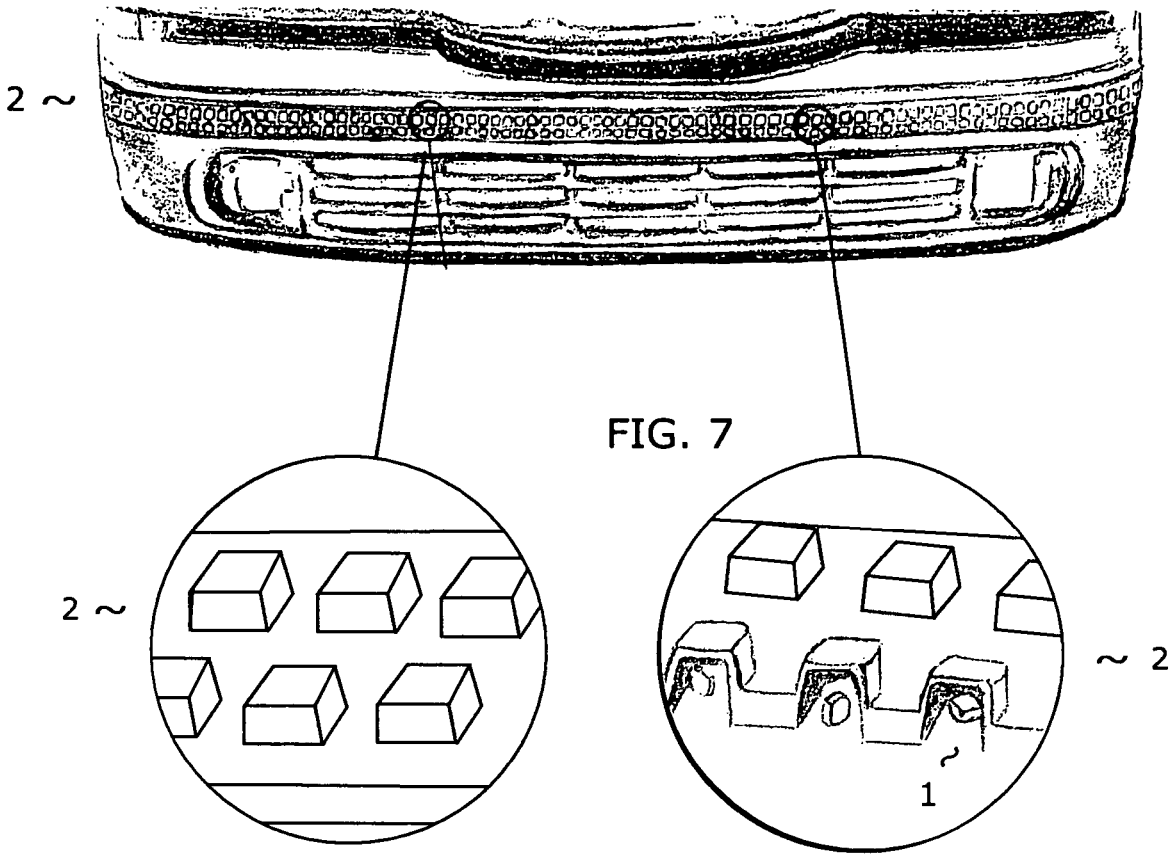
FIG. 7 shows a device holder attached to a vehicle.
Figures 8, 8A, 8B:
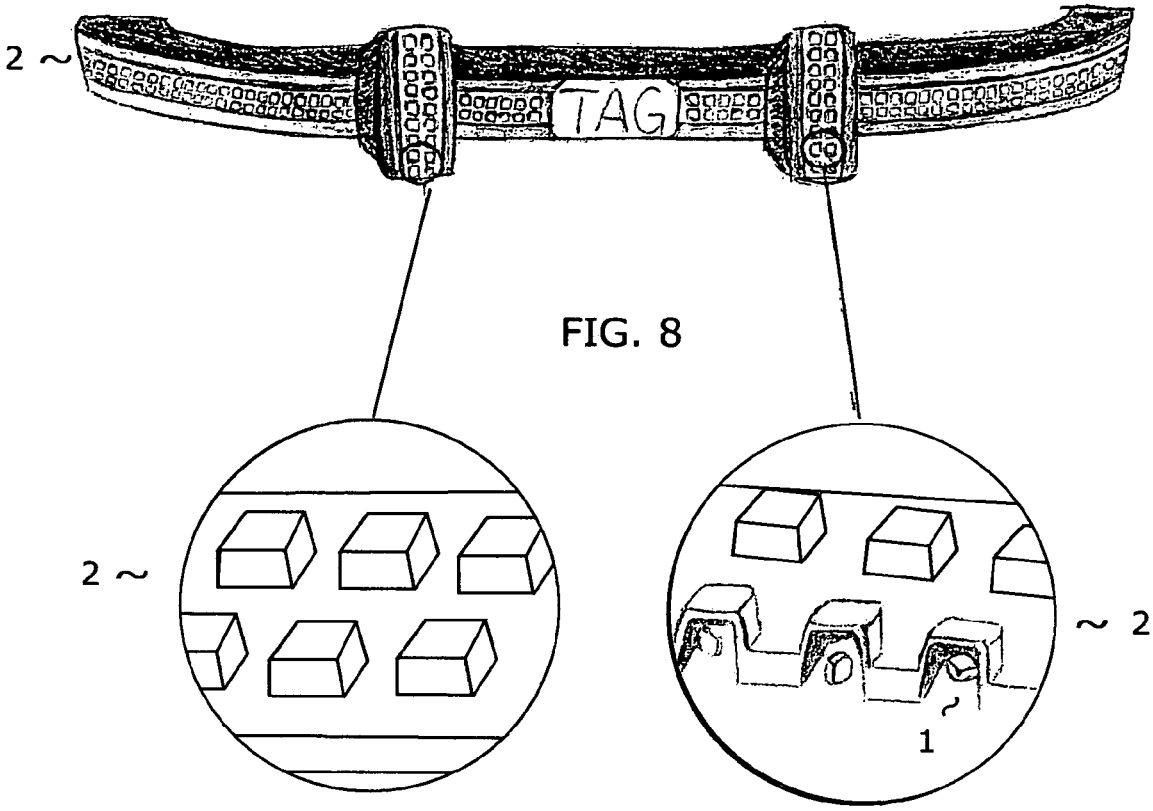
FIG. 8 shows a device holder attached to a vehicle with a different design bumper.

Referring to FIGS. 7 and 8, it can be seen that the lens (2) would have the appearance of an "upside down" ice cube tray. There would typically be two rows of "cubes" (or receptacles) spanning its length. Each cube would contain a single RFID (1) These RFID's would be assembled loose within their compartments to aid in their unrestricted release upon impacting with another object.

Attention is drawn to the fact that FIG. 8 is a representation of a device holder (2) attached to a vehicle with a different design bumper.

Note that in both FIGS. 7 and 8, the sizes of the device holders are for illustrative purposes only. In reality, they would be much smaller (and unobtrusive).

Figure 6:
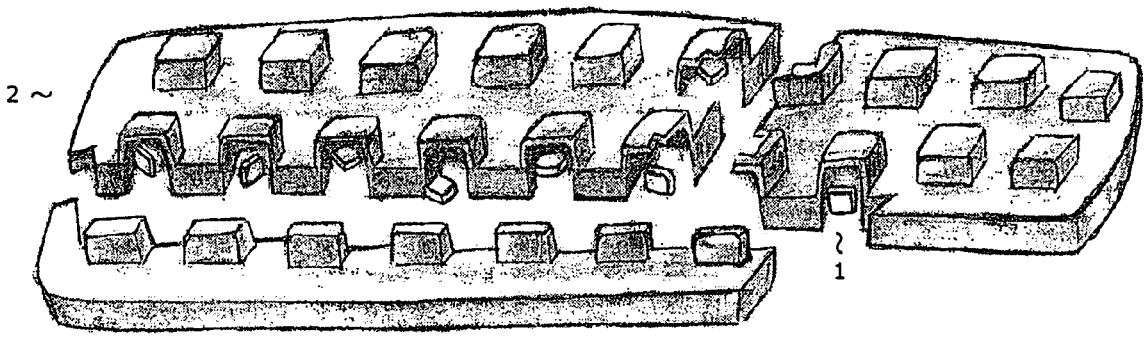
FIG. 6 shows a fractured device holder with the RFID's falling out.

Referring to FIG. 6, a fractured device holder (2) is shown illustrating the RFID's (1) being released.

Due to design considerations (bumpers that become narrow in some areas, for example), it might be necessary to use only one row of cubes instead of the usual two. Also for the same reason, it might be necessary to affix several device holders to the vehicle instead of a single, continuous one. These device holders could either be rectangular or square, once again depending on specific vehicle design.

Referring again to FIG. 5, to prevent tampering by unauthorized personnel, special "tamper resistant" screws (5) with unique heads would be used to assemble the unit. These screws would require the use of a proprietary tool.)

As hereinbefore set forth, the front and rear areas of each motor vehicle would be equipped with its own device holder. In addition, a separate device holder would be attached to each side of a vehicle. The purpose of having device holders in those locations would be to leave evidence behind in a "side swipe" type of accident.

Pursuant to the present invention, provision would be made for device holders to be available from the vehicle's manufacturer and be "make and model specific." New vehicles would have device holders incorporated within their designs.

Regulation of RFID's and Their Device Holders

In the practice of the present invention, RFID's and their device holders would be issued by local state Departments of Motor Vehicles.

Installation would be done by authorized personnel only. Police could incorporate checks of devices when pulling over motorists for moving violations. It is also suggested that they be examined like motorists are now at so called "sobriety checkpoints" with these unannounced checkpoints being established solely for this purpose. A quick (non-invasive) verification of the coded RFID media could be accomplished with the used of handheld readers (also known as "interrogators"). Inspection of devices could also become a part of the safety inspection for those states having mandatory such inspections at predetermined intervals.

Prohibitive fines could be levied in cases of tampering and/or removal of devices. Drivers who do not report tampering (i.e. broken lens, loss of media, etc.) for any reason could be subject to such large fines.

In carrying out the present invention, it should be noted that an added benefit of having vehicles leave evidence behind (in the form of RFID's), is that drivers would now feel compelled to report having been involved in accidents—regardless of circumstances.

The pre-set shattering (i.e. strength and composition) of the protective lens covers would be established by the appropriate regulatory agencies. This shattering (or separating) pressure to be translated into equivalent miles per hour of impact. Optimally, it will be set above the limits that would normally be associated with a slight impact in order to prevent unnecessary breakage (and subsequent loss of media).

How Code Will Be Assigned:

When a vehicle is sold (or registration information changes for any reason), the appropriate state Department of Motor Vehicles duly lists these changes in their databases.

I propose for this application that all state Department of Motor Vehicles receive bulk quantities of RFID's from a designated company. Along with these devices would be a list (or "range") of available codes that could be used for programming. Once assigned, this code could not be altered and could only be "unlocked" by a software program furnished by the previously mentioned company.

With the hexadecimal format (16 to the $16^{th}$ power) that would be used for this code, there are a total of ten quintillion (10,000,000,000,000,000,000) possible code sequences. Individual states could elect to use their assigned code ranges in either a serialized or random manner.

Each motor vehicle registered in that state's database would then receive the required number of these RFID's; with a single (identical) code assigned (i.e. programmed) to them as a whole.

Attention is drawn to the fact that since device holders would be pre-manufactured, the specific number of RFID's required for each vehicle would already be known.

Once assigned, this code would then be entered into a designated company's proprietary database along with the following:

a). The vehicle identification (or "vin") number of the motor vehicle b). The year of manufacture for the motor vehicle c). The make of the motor vehicle d). The model of the motor vehicle e). The state of registration for the motor vehicle (In order for the database to remain current, state DMV's would be required to input new information to it on a regular basis).

Therefore, as has been previously discussed, the unique code contained within the RFID's would act as an identifier for the "vin" number of the vehicle (along with the rest of its information). The entering of this code into the proprietary database would be the first step in locating the driver of the vehicle.

The code would remain with that vehicle and all new vehicle registration information would "update" to that code with the code itself never changing. The issuance of new tags, registration of the vehicle in another state, a change of ownership, etc. would all update to this permanently assigned code. (In the same manner that the above information currently updates to the permanently assigned "vin" number of a vehicle.)

Non-programmable RFID's could also be used. These RFID's would have their codes pre-assigned (i.e. "pre-programmed") to them at the factory and this code could never be altered.

Each agency would receive it's allotment of devices from the manufacturer and—just as with the programmable ones—would have the option of using their codes in either a serialized or random manner. A segment of these codes would then be assigned to each motor vehicle.

The disadvantages of this particular system would be the assigning of numerous codes (or "identifiers") for each application; even though they would all lead back to the same vehicle.

Figure 10:
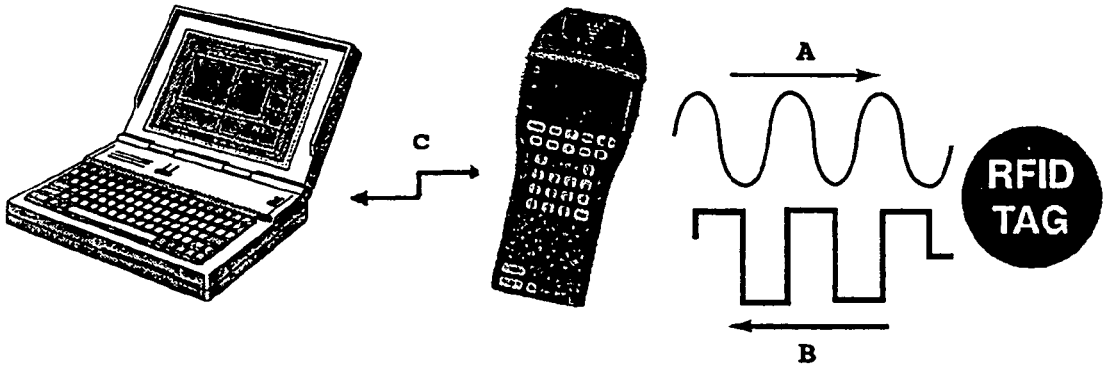
FIG. 10 shows an RFID system as it would apply to this invention.

How Code Will Be Recovered:

Referring to FIG. 10, the coded information can be obtained in the field with the (previously mentioned) hand-held readers or "interrogators". These units will display the hexadecimal format of the coded sequences on a display screen. These readers will be connected by means of an RS232 port to a laptop computer.

The laptop computer will contain the software program necessary to decode this information; accomplishing this with the use of a "customer specific" algorithm. This algorithm is typically contained within an uncoupler or "chip" located on the computer's motherboard.

How the Owner of the Motor Vehicle Would Be Located:

Referring to FIG. 11, When the RFID is retrieved from the accident scene, it's code would then be entered into the designated company's proprietary database. The entering of this code (11) would yield the following information (in a simultaneous manner):

a). The vehicle identification (or "vin") number of the motor vehicle (12)

b). The year of manufacture for the motor vehicle (13)

c). The make of the motor vehicle (13)

d). The model of the motor vehicle (13)

e). The current state of registration for the motor vehicle (14)

That specific state Department of Motor Vehicles, in this case, "Virginia," (along with the vehicle's "vin" number), would then be provided to the law enforcement investigator. The contacting of this DMV would lead to the registration information for the motor vehicle—and the identity of the owner.

It should be noted that law enforcement agencies are the only ones who would be able to obtain the above information. It should also be noted that law enforcement agencies would not have access to the proprietary database. These would remain two separate—and distinct—investigative tools.

Pre-existing Databases:

One skilled in the art will appreciate the fact that a national database of vehicle identification or "vin" numbers for all motor vehicles registered in the United States is currently in use on the internet and is, indeed, available to the general public. Two examples (at the time of this application) are "www.Autocheck.com" and "www.Free-Vin-Checkcom." These databases list all of the information previously mentioned in paragraph [0074].

Referring to FIG. 9, a sample download from a website known as "www.AutoCheck.com" is shown. Prospective car buyers wanting to know a vehicle's history would first enter that vehicle's "vin" number (8) into the website's database. Once again, this would yield the following information:

a. The year of manufacture for the motor vehicle (9)

b. The make of the motor vehicle (9)

c. The model of the motor vehicle (9)

d. The current state of registration for the motor vehicle (10)

Attention is drawn to the fact that the matching of an RFID code to it's co-identifying "vin" number in a proprietary database would be the only unique step in this process. The other two steps, the researching of a vehicle's "vin" number in a commercial website's database as well as the matching of a "vin" number to the owner of a vehicle in a particular state DMV registry are already quite common and occur countless times on a daily basis.

It is a feature of the invention that the registration information of a vehicle can be obtained on site; that evidence doesn't need to go thru the time consuming process of being sent to a lab for analysis. This can expedite obtaining the identity of the offender. Quite often those involved in hit and run accidents are not arrested until later (if indeed, ever) and time can be of the essence in determining if someone is under the influence of alcohol or drugs.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures.

What is claimed is:

1. A method of identifying a vehicle involved in a collision, said method comprising the steps of:

a) providing a plurality of RFIDs and program coding said RFIDs with vehicle identification data unique to said vehicle;

b) storing said coded RFIDs in a breakable holder in a manner such that said RFIDs are releasably contained in said holder;

c) attaching the said holder, containing said coded RFIDs, to a collision impact area of said vehicle;

d) releasing said coded and stored RFIDs from said vehicle attached holder and to the scene and location of a collision with another vehicle or object when said collision causes said holder to be broken and the releasably stored RFIDs are released from said holder; and e) identifying the vehicle involved in said collision by identifying the RFIDs which have been released to the scene of the collision.

2. The method of claim 1 further including a step of identifying a vehicle involved in a "hit and run" collision event by the data contained in the passive radio frequency identifier RFID devices of said vehicle that have been released from the said vehicle.

3. The method of claim 1 further including a step of recovering and identifying the vehicle coded RFIDs at the scene of said collision by authorized personnel and authorized law enforcement personnel.

4. The method of claim 1 further including a step of providing a proprietary database for storing the RFID data for each vehicle having RFIDs coded with vehicle identification data unique to each said vehicle.

5. The method of claim 4 further including a step of providing to said proprietary database the coded RFID data recovered at the scene of said collision and retrieve from the database the corresponding VIN to identify the vehicle involved in the collision with another vehicle or object.

6. The method of claim 5 further including a step of: providing said proprietary database providing the coded RFID data recovered at the collision location, to a law enforcement agency, and said agency reporting said RFID data to a designated State Department of Motor Vehicles in order to obtain the identity of the owner of said vehicle.

7. The method of claim 1 further including a step of: providing a roadside checkpoint whereat the RFIDs of each vehicle are identified and compared to the RFID data stored at a proprietary database for said each vehicle, and inspecting the RFID device holders of each vehicle to determine if the holders have been damaged or tampered with.

8. An apparatus for leaving evidence identifying a vehicle at the scene of a collision involving said vehicle, said apparatus comprising a holder comprising a base, means for connecting the base to a collision impact area of the vehicle, a breakable cover connectable to the base so as to define with the base at least one chamber, each chamber containing at least one passive radio frequency identifier (RFID) device, each said RFID device containing data uniquely identifying said vehicle, said cover being designed to break upon a predetermined impact so as to discharge said RFID device at the scene of the collision.

9. The holder apparatus of claim 8 wherein the base and the cover are constructed of a flexible and waterproof material so as to be attachable to each other and the contours of a motor vehicle the RFIDs identify.

10. The holder apparatus of claim 8 wherein said cover is composed of a sunlight resistant, opaque material.

11. The holder of claim 8 wherein the interior surfaces of said holder and the surface of each said RFID has a fluorescent or infrared paint thereon to facilitate recovery from a collision scene.

12. The holder device of claim 8 wherein the RFIDs have magnetic strips attached to them to facilitate recovery at collision scenes by means of a metal detector.

13. The holder apparatus of claim 8 further comprising tamper-resistant fasteners interconnecting said substrate, said gasket, and said breakable front cover containing the RFIDs, said fasteners having unique head configurations that require the use of a proprietary tool, so as to act as a deterrent against tampering with the assembled devices by unauthorized personnel.

* * * * *